United States Patent [19]

Lewis, Jr.

[11] Patent Number: 4,739,994

[45] Date of Patent: Apr. 26, 1988

[54] LACROSSE STICK WITH GRAPHITE-LOADED HANDLE

[75] Inventor: Fielding H. Lewis, Jr., Queenstown, Md.

[73] Assignee: Wm. T. Burnett & Co., Inc., Baltimore, Md.

[21] Appl. No.: 924,279

[22] Filed: Oct. 29, 1986

[51] Int. Cl.[4] ..... A63B 59/02

[52] U.S. Cl. ..... 273/326

[58] Field of Search ..... 273/326, 73 J, 75

[56] References Cited

U.S. PATENT DOCUMENTS

| | | | |
|---|---|---|---|
| 3,507,495 | 4/1970 | Tucker et al. | 273/326 |
| 3,702,702 | 11/1972 | Hoult | 273/326 |
| 3,822,062 | 7/1974 | Tucker et al. | 273/326 |
| 4,037,841 | 7/1977 | Lewis, Jr. | 273/326 |
| 4,206,918 | 6/1980 | Lewis, Jr. | 273/326 |
| 4,436,305 | 3/1984 | Fernandez | 273/73 J X |

FOREIGN PATENT DOCUMENTS

| | | | |
|---|---|---|---|
| 424742 | 2/1935 | United Kingdom | 273/326 |

*Primary Examiner*—William H. Grieb
*Attorney, Agent, or Firm*—A. W. Breiner

[57] ABSTRACT

A lacrosse stick having a graphite-loaded plastic handle to provide improvement in handling characteristics. The handle is preferably comprised of 80 to 95 percent plastic and 5 to 20 percent graphite. The handle may be polygonal or tubular in shape, and is preferably octagonal. Dimensions and physical properties of the handle material are interrelated to provide desired balance of the lacrosse stick from the standpoint of handling by players, durability, freedom from failure by fracturing, and standardization in production.

9 Claims, 1 Drawing Sheet

LACROSSE STICK WITH GRAPHITE-LOADED HANDLE

This invention relates to lacrosse sticks, and especially to a lacrosse stick including a graphite-loaded plastic handle which is formed to provide advantages as to grip, strength, safety, weight distribution, and comfortable feel in the hands of a player.

BACKGROUND OF THE INVENTION

In the early prior art, lacrosse stick handles were customarily made of wood, usually hickory, shaped by American and Canadian Indians with whom the game originated. Such handles lack uniformity as to quality, strength, weight, and feel in the hands of a player. Additionally, wooden handles were susceptible to failure by fracturing, leaving jagged ends with a resultant extreme danger of severe injury to players in the game so roughly played.

U.S. Pat. No. 3,702,702 to Hoult dated Nov. 14, 1972 proposes the use of a lacrosse stick handle comprising a composite of an outer plastic tube (illustrated as non-metallic) of octagonal cross-section and an inner core of wood or aluminum. Moreover, many attempts were made to provide handles of metallic construction. However, all attempts were unsuccessful due to inadequate strength or in that they were too heavy, and/or they did not have the desired player feel until the introduction of the tubular metallic handles as described in U.S. Pat. No. 4,037,841 issued July 26, 1977 and U.S. Pat. No. 4,206,918 issued June 10, 1980.

While the metallic handles of U.S. Pat. Nos. 4,206,918 and 4,037,841 have many beneficial qualities and have been widely accepted by players, a plastic lacrosse stick handle having the strength and durability characteristics of a metal handle and the handling and production characteristics of a plastic handle has not been available to the lacrosse player until the introduction of the present invention.

OBJECTS OF THE INVENTION

An object of the present invention is to provide a lacrosse stick having a graphite-loaded plastic handle overcoming the disadvantages of prior art handles, especially with respect to standardization, desirable weight distribution with the stick head, strength and avoidance of fracturing, and having improved grip and feel under virtually all conditions.

It is another object of the present invention to provide a lacrosse stick handle made out of plastic and loaded with 5 to 20 percent graphite to give the lacrosse stick a new feel and to provide a more balanced stick. The new lacrosse stick handle provides for faster shots, a greater optimization of the power transfer between the player and the lacrosse stick head and handle, and an overall superior performing lacrosse stick compared to those now in use.

It is a further object of the invention to provide a graphite-loaded plastic lacrosse stick handle having an engineered flex to provide the player with a superior performing lacrosse stick.

It is a further object of the invention to provide a graphite-loaded plastic lacrosse stick handle which is warm to the touch in cold weather and which remains cool in warm weather.

Other objects of the invention will become apparent from the following description and drawings.

GENERAL DESCRIPTION OF INVENTION

The objects of the present invention are accomplished by providing a polygonal or tubular plastic lacrosse stick handle which is loaded with 5 to 20 percent graphite during fabrication. The graphite-loaded plastic handle provides improved handling characteristics which is an important feature of a lacrosse stick. Thus, the handle has the requisite player feel which, although an intangible characteristic, is of real and critical importance in the fabrication and manufacture of a lacrosse stick. Moreover, the handle of the invention provides the essential balance between weight distribution, physical properties, control under all conditions, and the desired feel in the hands of a player.

Figure 1:
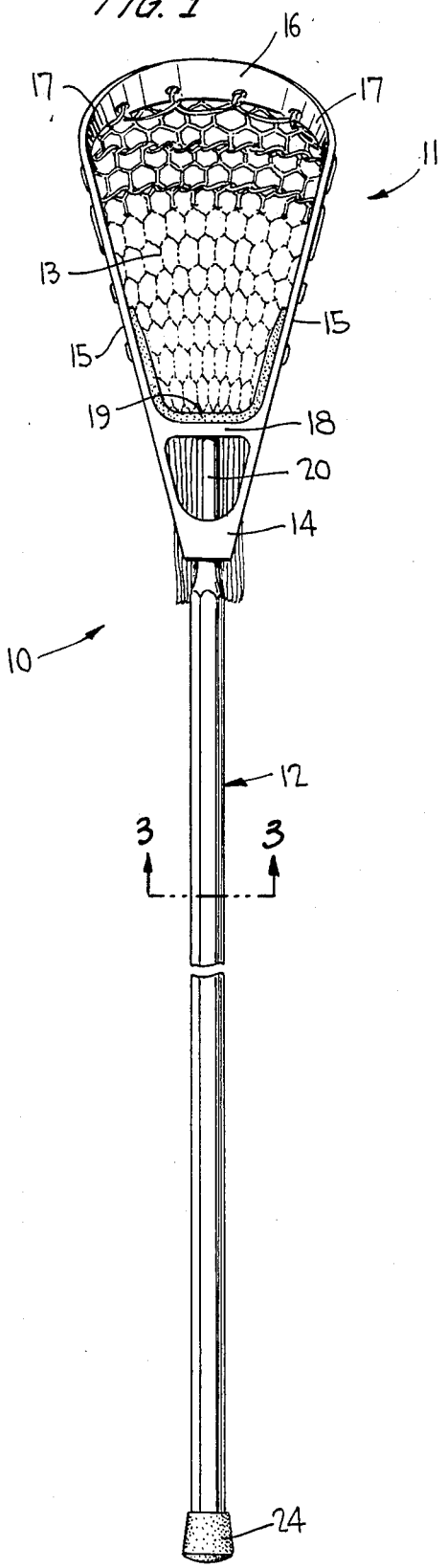
FIG. 1 is an elevational view of a lacrosse stick having an octagonal handle, the handle partly broken away.

The illustrative embodiments of the invention are of a lacrosse stick generally designated 10 which includes a head generally designated 11 and a handle generally designated 12. The head is provided with webbing or netting generally indicated at 13.

The head 11 is constructed similarly to a head disclosed in the Tucker et al, U.S. Pat. No. 3,507,495 issued Apr. 21, 1970 and shown also in a later Tucker et al, U.S. Pat. No. 3,822,062 issued July 2, 1974. The head 11 is, in general, a closed frame-like construction with a generally V-shaped design preferably substantially symmetrical. The lower end of the head is formed as a throat 14 from which two side walls 15, 15 are inclined and diverge upwardly and outwardly. The upper ends of the side walls 15, 15 are connected by a transverse top or end wall 16 which merges with the side walls through intervening smoothly curved portions 17, 17.

A transverse stop 18 extends between the side walls 15, 15 and cooperates with the throat 14 and adjacent portions of the side walls to facilitate the connection of the head 11 and the handle 12. Positioned inside the stop 18 is a layer 19 of relatively soft resilient material which provides for improved ball handling properties.

The Tucker et al, U.S. Pat. No. 3,822,062 more particularly discloses an arrangement which may be embodied in the webbing 13 shown in FIG. 1 by the way of example. Since details of construction of the webbing per se are not part of the present invention, reference to U.S. Pat. No. 3,822,062 is, therefore, sufficient as to disclosure of one suitable kind of webbing.

The head 11, aside from the webbing 13, is preferably formed as a unitary molding of a polymeric material characterized by toughness, high impact resistance, and limited flexibility as well as other desirable properties explained in the aforesaid U.S. Pat. No. 3,507,495. A presently preferred material is a nylon resin marketed under the duPont trademark ZTEL ST 801. This polymer has outstanding impact resistance and good moldability permitting injection molding. Unreinforced ZTEL ST 801, with a water content of 0.2 percent, at 73° F. using the ASTM test method D638 has a tensile strength of 7800 psi, a yield strength of 7800 psi, and an elongation at break of 40 percent. It has a specific gravity of 1.09 using the ASTM test method D792, and a Rockwell hardness of R112 using ASTM test method D785. Another material suitable for making head 11 is the reaction product of Adiprene L315 and 4,4'-methylene-bis-(2-chloroaniline) using the formulation and manufacturing procedure as set forth in the aforesaid U.S. Pat. No. 3,507,495, the disclosure of the '495 patent being incorporated herein by reference. The above-noted materials are examples of materials suitable for constructing the head found to cooperate admirably with the handle of the present invention. An additional lacrosse stick head suitable for use with the present invention is disclosed in pending application Ser. No. 06/778,067 filed Sept. 20, 1985 for "Lacrosse Stick Having Open Sidewall Structure," and is incorporated herein by reference.

The present invention, as above noted, is primarily related to the handle 12, although the correlation between the head and the handle is a further aspect of the invention. The handle is formed of plastic which in the illustrative embodiment is a thermoplastic polyester. As shown in FIGS. 2 and 3, the preferred embodiment of the handle has an octagonal cross-section of uniform dimension extending throughout the entire handle. The head throat 14 and stop 18 have aligned openings, as apparent from FIG. 1, which receive the end part 20 of the handle 12 which is swaged to provide a generally rounded contour for detachably connecting the handle to the head. Any suitable fastening device such as a screw, not shown, can be used for releasably securing the head to the handle.

A cap 24 of relatively soft material such as rubber or plastic is fitted over the lower end of the handle.

Figure 2:
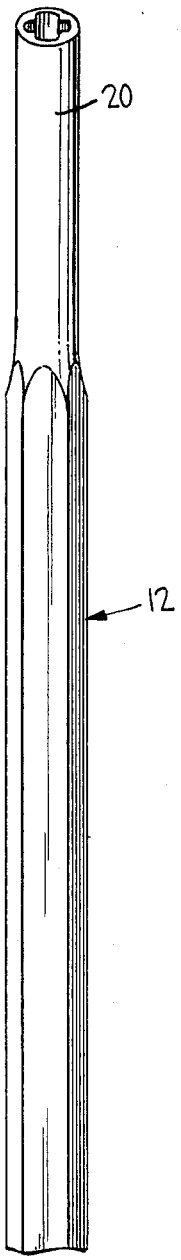
FIG. 2 is an enlarged scale perspective view of the lacrosse stick handle.
Figure 3:
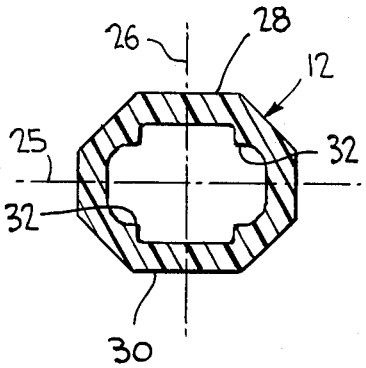
FIG. 3 is a cross-section on line 3—3 of FIG. 1.

As shown in FIGS. 1 through 3, the handle is preferably octagonal in cross-section. As seen in FIG. 3, the octagonal handle has a major axis 25 and a minor axis 26. The segments 28 and 30 of the octagon intersected by axis 26 are wider than the other segments. Internal ribs 32 at the segments adjacent each end of segments 28 and 30, and opposed to each other, provide uniform reinforcement to the handle, increasing strength while retaining flexibility.

Although illustrated as an octagon, a handle having an elliptical cross-section as fully described in my earlier U.S. Pat. Nos. 4,037,841 and 4,206,918 may also be used in conjunction with the present invention, the disclosures of the '841 and '918 patents being incorporated herein by reference.

As seen in FIG. 2, the preferred lacrosse stick handle is uniform in dimension throughout the entire length of the handle. Such uniformity of dimension, while not detracting from the superior playing characteristics of the lacrosse stick, provides for ease of manufacture of the handle and fabrication of the lacrosse stick.

As further described in my earlier U.S. Pat. Nos. 4,037,841 and 4,206,918, dimensional relationships may vary according, for example, to whether the handle is to be part of a lacrosse stick used by attack and midfield players or is to be used by defense players. Generally considered, lacrosse sticks used by defense players may suffer more frequent and sometimes more severe shocks, as by impact, than the attack and midfield sticks. Factors of lightness, limited flexibility and strength contribute to the suitability for use by attack and midfield players. In a preferred handle for an attack and midfield stick, using plastic as disclosed hereinafter, a preferred wall thickness is 0.135 inch, although a wall thickness in the range of 0.120 inch to 0.170 inch may be used in accordance with the invention.

Since lacrosse sticks are subjected to rough contact, especially whacks or blows, physical properties of the handle material are important. Of outstanding importance is the modulus of elasticity, although ultimate strength, yield strength and elongation have to be considered. The modulus of elasticity is defined as the ratio of stress to corresponding strain throughout the range where they are proportional.

The graphite-loaded plastic lacrosse stick handle disclosed herein having physical properties such as are set forth will not fracture when subjected to heavy load, as by impact, as would a wood or fiberglass handle. Any stress induced failure of a handle would be by way of plastic deformation, minimizing the danger of injury to a player.

Preferred plastic materials suitable for use according to the present invention are thermoplastic polyesters, polycarbonates, and nylon, and blends of these polymers. Other thermoplastic polymers having the required and similar physical properties may also be used.

Handles for defense sticks should be of a thermoplastic polyester material having the physical properties as set forth above. As in the case of handles for attack and midfield sticks, the above-referenced plastics may also be used for defense sticks. However, because of the rougher use to which defense sticks may be subjected, there are some differences in the dimensions of the defense stick handle as compared to those of the attack and midfield handle. Balancing such factors as lightness and strength, the optimum wall thickness of a defense stick handle is 0.170 inch, somewhat above the 0.135 inch thickness of the attack and midfield handle wall thickness. The defense handle wall thickness may vary in a range up to 0.200 inch. A defense stick handle having the optimum wall thickness 0.170 inch weighs 530 grams or 1.2 pounds per lineal foot. A defense stick head is only slightly heavier than an attack and midfield stick head, that is approximately 7 or 8 ounces in a typical case, but the weight of the defense stick head may range up to 13 ounces. Normally a defense stick is furnished with a handle 58 inches long, and the particular player may cut it down to suit his individual feel and preference to 46 inches long.

It has been found that an extremely superior lacrosse stick handle may be fabricated by using 3 to 30 percent graphite in conjunction with the above-referenced plastics. The graphite is uniformly dispersed in the plastic prior to molding the handle. While graphite loading in the range of 3 to 30 percent provides for a superior plastic handle, it has been found that 9 to 16 percent graphite is a preferred range. After the graphite and plastic are uniformly admixed, the combination graphite and plastic is molded by known molding techniques, for example extrusion molding, to form an improved lacrosse stick handle.

A preferred embodiment of the present invention is comprised of mixing 90 percent of the thermoplastic polyester/polycarbonate blend XENOY TM, manufactured and sold by the General Electric Company, with 10 percent graphite. The graphite/XENOY TM mixture is then extrusion molded to form an attack or midfield lacrosse stick handle having a wall thickness of 0.135 inch, a 1.06 inch major axis, and a 0.09 inch minor axis.

Lacrosse sticks according to this invention have the advantage of being producible with standardization in weight distribution and physical properties and hence durability. The preferred octagonal cross-section provides for comfortable grasp and feel desired by players and also distributes the material of the handle so as most efficiently to withstand stress for a given weight of handle. In case of extremely hard contact, any deformation of the handle is a plastic deformation as distinguished from breaking or fracturing to which prior art wooden and fiberglass handles are susceptible. Eliminating fracturing of handles is an important safety consideration. Furthermore, handles in accordance with the invention will not warp. The advantages set forth above by way of illustration are obtained by the balancing of weight and distribution of the material in the handle of octagonal cross-section taken in connection with the physical properties of the handle material.

The lacrosse stick illustrated and described embodies the invention in a preferred form, but the disclosure is intended to be illustrative rather than definitive.

It is claimed:

1. A lacrosse stick comprising a head; and a hollow handle in which the wall thickness of said handle is within the range of 0.120 and 0.200 inch, and said handle comprising approximately 70 to 97 percent plastic and approximately 3 to 30 percent graphite.

2. A lacrosse stick comprising a head; and an octagonal handle of octagonal hollow cross-section, the major axis of said cross-section being normal to the general plane of said head, said handle being comprised of approximately 80 to 95 percent plastic and approximately 5 to 20 percent graphite.

3. The lacrosse stick of claim 1 wherein the said graphite is in the range of 9 to 16 percent.

4. The lacrosse stick of claim 1 which includes a plurality of internal reinforcing ribs.

5. The lacrosse stick of claim 1 wherein the said handle is octagonal.

6. The lacrosse stick of claim 5 which includes a plurality of internal reinforcing ribs.

7. The lacrosse stick of claim 6 wherein the plurality of ribs is four and pairs of the ribs are directly opposed to each other.

8. The lacrosse stick handle of claim 1 wherein the said handle is tubular.

9. The lacrosse stick of claim 1 wherein the plastic is a thermoplastic polyester.

* * * * *